United States Patent [19]

Haven

[11] 4,254,360

[45] Mar. 3, 1981

[54] INSULATED WEB COLLECTOR STORAGE TARGET FOR A CATHODE RAY TUBE

[75] Inventor: Duane A. Haven, Banks, Oreg.

[73] Assignee: Tektronix, Inc., Beaverton, Oreg.

[21] Appl. No.: 138,471

[22] Filed: Apr. 8, 1980

Related U.S. Application Data

[63] Continuation-in-part of Ser. No. 6,146, Jan. 24, 1979, abandoned.

[51] Int. Cl.[3] ..... H01J 29/39; H01J 31/08

[52] U.S. Cl. ..... 313/395; 313/398

[58] Field of Search ..... 313/391, 395, 397, 398

[56] References Cited

U.S. PATENT DOCUMENTS

| | | | |
|---|---|---|---|
| 3,293,473 | 12/1966 | Anderson | 313/398 |
| 3,293,474 | 12/1966 | Gibson | 313/395 |
| 3,339,099 | 8/1967 | Anderson | 313/398 |
| 3,430,093 | 2/1969 | Winningstad | 313/397 X |
| 3,710,173 | 1/1973 | Hutchins et al. | 313/395 X |
| 3,978,366 | 8/1976 | Steele | 313/398 |
| 3,982,150 | 9/1976 | Mossman | 313/398 |
| 4,110,659 | 8/1978 | Mason et al. | 313/398 |
| 4,159,439 | 6/1979 | Haven et al. | 313/398 |

*Primary Examiner*—Palmer C. Demeo

*Attorney, Agent, or Firm*—John D. Winkelman

[57] ABSTRACT

An improved bistable storage target structure for a cathode ray tube includes a faceplate-supported apertured web collector electrode and a discontinuous layer of secondary emissive material formed by a plurality of phosphor deposits disposed within the web apertures. A layer of insulating material is provided overlying the web electrode to electrically isolate the phosphor deposits.

12 Claims, 5 Drawing Figures

INSULATED WEB COLLECTOR STORAGE TARGET FOR A CATHODE RAY TUBE

CROSS-REFERENCE TO RELATED APPLICATION

This is a continuation-in-part of application Ser. No. 6,146, filed Jan. 24, 1979, and now abandoned.

BACKGROUND AND OBJECTS OF THE INVENTION

The present invention relates generally to cathode ray storage tubes, and more particularly to an improved storage target structure for such tubes.

U.S. Pat. No. 3,293,474, issued Dec. 20, 1966 to Charles B. Gibson, Jr. and assigned to the assignee of the present invention, discloses a storage target construction that includes a mesh-like collector electrode formed on one side of an insulating support plate. Deposits of a bistable storage material, suitably a phosphor of the P-1 type, are disposed in the openings of the electrode and isolated from one another by the mesh-like conductor.

In the commercially produced embodiment of the Gibson, Jr. target—i.e., the one shown in FIG. 2 of the above-mentioned patent—the deposits of phosphor storage material physically contact the conductive mesh. This causes an undesirable effect known as "rim-lighting" during operation of the target in a storage CRT. Rim-lighting is characterized by a halo or ring of light surrounding storage phosphor deposits in the unwritten or background areas of the target. The resulting increase in background luminance significantly reduces display contrast and impairs the viewability of displayed information.

Several explanations for rim lighting have been advanced. One is that the surface of each unwritten phosphor deposit somehow attains a surface charge that decreases with distance from the deposit's interface with the collector electrode. (As is understood, the collector normally is maintained at a potential several hundred volts higher than the CRT's flood gun cathodes.) At some distance D from the interface, the deposit's surface potential is equal to the first crossover voltage for the phosphor, i.e., the voltage at which its secondary emission ratio $\delta$ is unity. The surface potential for regions of the phosphor lying between the collector interface and point D thus will be above first crossover ($\delta > 1$), and flood gun electrons will tend to charge those regions in a positive direction—i.e, toward collector potential. However, at distances greater than D from the collector phosphor interface, the surface of the deposit will be below first crossover ($\delta > 1$) and those regions will be charged in the opposite direction toward flood gun cathode potential—typically 0 volts. As a result, each phosphor deposit will include a positively charged peripheral region that remains in a luminous or "written" state whenever the CRT is operated in a storage mode.

It might seem that rim-lighting could be avoided by making the phosphor deposits slightly smaller than the mesh apertures so that they do not contact the collector electrode, but this has not proved to be effective unless a relatively large separation is created. Thus, in the version of the Gibson, Jr. target shown in FIG. 4 of the patent, rim-lighting would be observed unless the depth of cavities 66 was significantly increased or the thickness of the phosphor storage dielectric layer 36' was reduced a corresponding amount. Both alternatives are unattractive, particularly from a manufacturing standpoint.

The problem of rim-lighting has been addressed in a different type of storage target—one of the raised "dot" collector type—by providing each conductive dot with a collar of insulating material. Thus, as shown in U.S. Pat. No. 4,159,439, issued June 26, 1979 to Duane A. Haven et al. and assigned to the assignee of the present invention, all but the outermost end of each raised collector member is coated with an insulating material to isolate the collector structure from the surrounding phosphor storage layer. While generally effective in minimizing rim-lighting, the process used to apply the insulating collars is not well suited for use in commercial manufacturing operations.

Accordingly, a general object of the present invention is to provide improvements in storage targets of the type that include an apertured web collector electrode, such as the above-mentioned Gibson, Jr. target.

A more specific object of the invention is to provide an improved storage target of the Gibson, Jr. type having minimal background luminance.

A still more specific object of the invention is to provide a storage target of the type that includes a faceplate-supported apertured web collector and a discontinuous layer of secondary emissive material formed by a plurality of phosphor deposits disposed within the web apertures, wherein a layer of an insulating material overlying the collector web isolates the phosphor deposits to minimize rim-lighting.

Another object of the invention is to provide an improved insulated web collector storage target capable of displaying stored information in a color that contrasts with that of the background.

Still another object of the invention is to provide an improved insulated web collector storage target capable of displaying stored information in a color that differs from that of displayed but unstored (i.e., "write-through") information.

A further object of the invention is to provide an improved, insulated collector storage target structure that exhibits superior display contrast and enhanced writing speed.

BRIEF DESCRIPTION OF THE DRAWING

The above and other objects, features and advantages of the present invention will become apparent as the following detailed description of its preferred embodiments is read in conjunction with the accompanying drawing, wherein.

DETAILED DESCRIPTION

Figure 1:
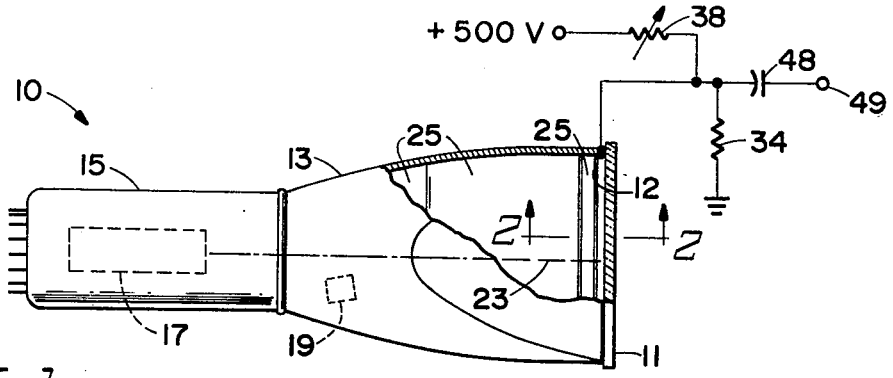
FIG. 1 is a simplified, partially cross-sectional side view of a direct viewing storage tube incorporating the improved target structure of the present invention, the tube being shown with certain associated circuitry.

Referring now to the drawings, and first to FIG. 1, a direct viewing bistable storage CRT 10 is shown to include an evacuated envelope comprising a transparent faceplate 11, a funnel-shaped body portion 13 and a tubular neck portion 15. Supported on the inner, or rear, surface of faceplate 11 is a storage target 12 constructed in accordance with the present invention. CRT 10 additionally includes a writing reading electron gun 17 mounted within next portion 15, and one or more flood guns 19. Electron gun 17 may be operated in a conventional manner to produce either a writing or a reading beam 23 of relatively high energy electrons directed at target 12, with suitable means (not shown) being provided to deflect the beam over the rear surface of the target as desired. Flood guns 19 are employed to bombard storage target 12 with relatively low energy electrons.

A plurality of electrodes are provided intermediate flood guns 19 and target 12 for focusing and collimating the low energy electrons. These electrodes may be in the form of spaced coatings, or bands, 25 of a conductive material, and function to distribute the flood gun electrons substantially uniformly over the rear surface of the storage target.

Figure 3:
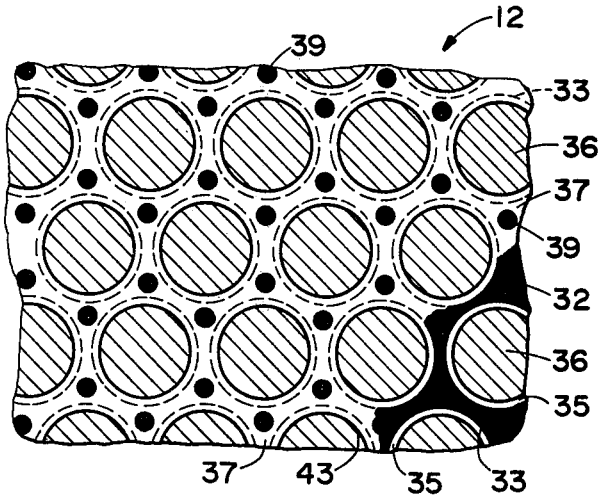
FIG. 3 is a view taken along line 3—3 in FIG. 2 showing the rear surface of the improved storage target.
Figure 2:
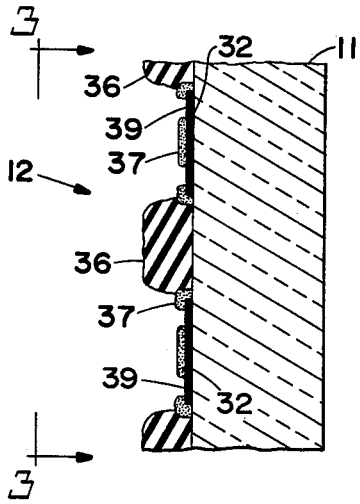
FIG. 2 is a fragmentary cross-sectional view on an enlarged scale showing an insulated web collector storage target according to one embodiment of the invention.

One embodiment of storage target 12 is shown in FIGS. 2 and 3 to include an apertured web, or mesh, electrode 32 provided as a patterned film or coating of a conductive material on one surface of an insulating support plate, suitably the rear surface of face-plate 11. Electrode 32 may be formed of a light transparent conductive material, such as a thin film of tin oxide, or a light opaque conductive material such as aluminum, gold, nickel, chromium or Nichrome, a nickel-chromium alloy. For economy of manufacture, a metal film such as Nichrome is preferred.

As best shown in FIG. 3, electrode 32 includes a multiplicity of apertures 33 arranged in a desired array or pattern and exposing faceplate surface areas 35 within which are located deposits 36 of a material capable of bistable storage. An apertured layer 37 of an insulating material overlies the elctrode web. The insulating layer, which serves both to isolate deposits 36 from electrode 32 and to define collector areas 39, includes a first pattern of openings 43 substantially in registration with web apertures 33 and a second pattern of openings exposing areas 39 on the surface of electrode 32. As will be understood, openings 43 are of a smaller diameter than apertures 33, and the insulating layer thus overlaps the edges of the web apertures to form a ring of insulating material on the portion of the faceplate surface area 35 surrounding each deposit 36.

The material of which deposits 36 are formed suitably is a conventional storage phosphor material, such as P-1 type phosphor ($Zn_2SiO_4$:Mn), a rare earth-activated rare earth phosphor such as terbium-activated lanthanum oxysulfide ($La_2O_2S$:Tb) or an admix of P-1 phosphor with a rare earth oxide or oxysulfide or a rare earth-activated rare earth oxide or oxysulfide as described in U.S. Pat. No. 4,110,659 issued Aug. 29, 1878 to William M. Mason et al. Because deposits 36 are in the form of separated areas or dots that are insulated from the collector electrode structure, even relatively conductive phosphors such as P-31 may be used as the storage material.

To provide a high contrast target—i.e., one with minimal rim-lighting—insulating layer 37 suitably is formed of a nonluminescent dielectric material, preferably one having a relatively high secondary emission ratio ($\delta$) such as aluminum oxide, thorium oxide, silica, or the like. Aluminum oxide and thorium oxide are particularly preferred. An enhanced writing rate is provided by the use of high $\delta$ insulating material. This is because the insulating material will reach a rest potential equivalent to the collector electrode voltage more quickly than the storage phosphor when addressed by the writing electron beam. However, since the insulating material adjoins the phosphor deposits, the latter will be quickly pulled up to the same rest potential by capacitive coupling.

In other applications of the insulated web collector storage target structure, layer 37 may be formed of a dielectric phosphor material. For example, to provide a vivid color difference between the background and image elements of a stored display, a target 12 may be produced in which the insulating layer is a storage phosphor that emits light of a color significantly different from that of phosphor deposits 36. Background areas of the display thus will be of one color—that produced by rim-lighting of the layer 37 phosphor in the regions surrounding deposits 36—while stored image areas will be of a contrasting color resulting from the combined emissions of the phosphors forming layer 37 and deposits 36. Such a target may, for instance, suitably include deposits 36 of $La_2O_2S$:Tb, a green-emitting storage phosphor, and an insulating layer 37 of europium activated yttrium oxysulfide ($Y_2O_2S$:Eu), which has a red phosphoresence. The red- and green-emitting phosphors combine to produce yellow-green images of stored information on a red background.

In a "write-through" mode of bistable storage tube operation, such as that described in U.S. Pat. No. 3,430,093 issued Feb. 25, 1969 to C. Norman Winningstad, a charge image may be displayed but not stored at the same time that another, stored charge image is displayed. Conventional, single phosphor storage targets display the stored and write-through (non-stored) images in the same color, typically green. Color differences between the two types of images can be provided by another variation of the insulated web collector storage target structure, one in which the insulating layer is formed of a non-storing phosphor that emits light of a different color and that has a lower emission efficiency under flood gun illumination conditions than the storage phosphor of deposits 36. For example, layer 37 can be a rare earth-activated rare earth oxide or oxysulfide such as $Y_2O_3$:Eu or $YVO_4$:Eu that has been "surface killed", and deposits 36 can be P-1 type phosphor. In such a target, stored images will be green in color and write-through images will appear orange.

Figure 5:
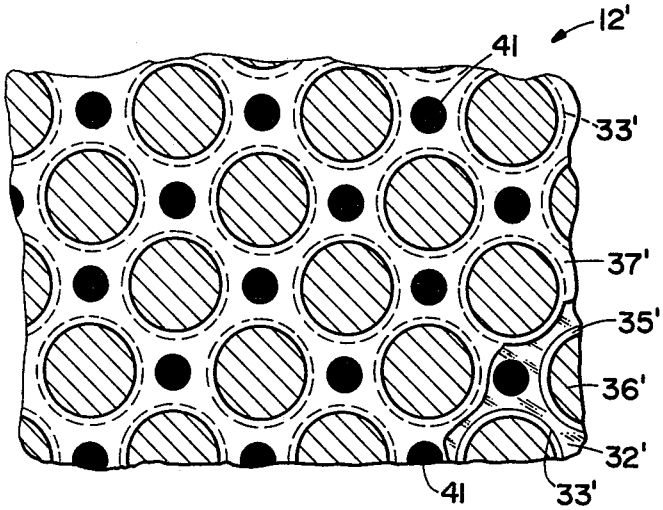
FIGS. 4 and 5 are views corresponding to those of FIGS. 2 and 3, respectively, showing on an enlarged scale an alternative embodiment of the invention.
Figure 4:
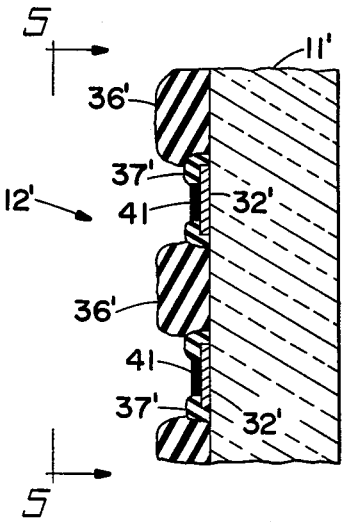

An alternative embodiment of an insulated web collector storage target 12' according to the present invention is shown in FIGS. 4 and 5. In this embodiment, an apertured web electrode 32' is formed of a transparent conductive material such as tin oxide. The collector areas of the target are defined by dot-like deposits 41 of a nontransparent conductive material such as gold or Nichrome. As in the previously-described embodiment, the insulating material of layer 37' extends into web apertures 33' and engages the portion of faceplate surface 35' surrounding each phosphor deposit 36'.

It will be understood that the patterns, configurations and relative sizes of storage deposits and collector areas may be varied widely depending on the intended use of the storage target and the materials and processes available for their manufacture. For example, the structural arrangement shown in FIGS. 2 and 3 is suitable when a display with high contrast and high written luminance is desired. In the version illustrated, the deposits 36 of storage material cover about 70% of the total target area, insulating layer 37 covers about 20% and the collector areas 39 occupy about 10% is viewed in FIG. 3. The arrangement shown in FIGS. 3 and 4 is preferred when a color write-through target is desired (one in which the insulating layer is a nonluminescent phosphor with different color and low voltage efficiency characteristics than the storage phosphor). In this application, a higher insulator phosphor area ratio is desirable. The version illustrated in FIG. 5 has about 50% of the total area covered with storage phosphor, insulating layer 37' covers about 40% and collector areas 41 occupy about 10%. The transparent web electrode also covers about 40%.

A storage target of the type shown in FIGS. 2 and 3 may be fabricated in the following manner: A thin, opaque layer of a conductive material such as gold, nickel or Nichrome is deposited on the cleaned rear surface of CRT faceplate 11 in a suitable manner—e.g., by sputtering or vacuum deposition. Next, a coating of a photosensitive etch resist is applied to the conductive layer and exposed through a mask having a pattern of light transmissive areas corresponding to the desired pattern of apertures 33 in web electrode 32. After developing the exposed resist coating, the uncovered areas of the underlying metal layer are removed using an appropriate etchant. Removal of the patterned resist coating (typically by washing in acetone or other suitable solvent) completes formation of an apertured web electrode 32 on faceplate 11. The process continues with the application of another coating of photoresist to the web-bearing faceplate. Next, the photoresist coating is exposed through a second mask having a pattern of light-transmissive areas corresponding to the locations of collector areas 39 in target 12. Development of the exposed resist coating produces a pattern of photoresist "dots" covering the collector areas on apertured electrode 32. The faceplate then is immersed in an electrolyte solution (suitably a solution of aluminum or thorium nitrate in isopropanol) containing small, positively-charged particles of an insulating material—e.g., alumium oxide or thorium oxide—in suspension. When a negative potential is applied to the web electrode, the suspended particles migrate to it and adhere to any unprotected areas (i.e., areas not covered by the previously-formed photoresist dots). The insulating material is deposited to a thickness of at least one micron, and preferably 2–5 microns, forming a layer 37 that covers the edges of electrode apertures 33. Phosphor deposits 36 are next formed using standard photographic deposition techniques. For example, a wet slurry layer composed of a suitable phosphor (100 g.), polyvinyl alcohol (100 g.) ammonium dichromate (20 g.), isopropanol (1 Ml.) and water (1000 ml.) is applied to the insulated web electrode-bearing face-plate and exposed to actinic light directed through the faceplate's front surface. The light passes through the openings in electrode 32 and insulating layer 37 to polymerize portions of the slurry layer overlying the uncovered regions of the faceplate's rear surface. Finally, the unexposed (and hence unpolymerized) portions of the slurry layer are washed away by a water rinse, and the faceplate is baked at a temperature sufficiently high to remove the photo-resist dots and the organic binder present in the polymerized phosphor material.

A target 12' of the type shown in FIGS. 4 and 5 may be made as follows: A thin, transparent conductive film, suitably of tin oxide or the like, is applied to the cleaned rear surface of faceplate 11' in a conventional manner. Over the tin oxide film is deposited an opaque layer of Nichrome or other suitable metal. Next, both conductive layers are sequentially etched through a conventionally-formed photoresist mask to provide an array of apertures 33' in the transparent film and overlying metal layer. The mask is removed, and an array of photoresist dots is formed on the metal layer at the sites where collector deposits 41 are to be defined. Deposits 36' of a storage phosphor are then formed on the uncovered faceplate surface within apertures 33' by standard photodeposition techniques. As will be understood, the phosphor deposits are smaller in diameter than the apertures in which they are formed, and do not contact the conductive film. The portions of the opaque layer not protected by photoresist next are removed using a etchant that will not attack the underlying transparent conductive layer. This step results in the formation of collector "dots" 41, which remain covered with photoresist. Finally, an insulating layer 37' of finely divided dielectric phosphor particles is electrophoretically deposited on the exposed areas of the transparent apertured web forming electrode 32', after which the faceplate is baked to eliminate the remaining organic binders and photoresist. As noted above, if the target is intended for differential color write-through operation, the dielectric phosphor particles of layer 37' will be surface killed or otherwise pre-treated to substantially reduce or prevent them from luminescing when bombarded by low energy (flood gun) electrons. A color contrast target can be provided by the use of phosphor particles that are not surface killed.

In operation of target 12, apertured web electrode 32 is connected to a DC voltage established across a load resistor 34 (FIG. 1) by a variable resistor 38 connected between the load resistor and a suitable DC voltage source. As will be understood, the target voltage applied to web electrode 32 is normally set within the "stable range" of target voltages over which phosphor deposits 36 will store a charge image. For a comprehensive description of bistable storage tube operation, reference may be made to U.S. Pat. No. 3,292,473 to Robert H. Anderson. Electrical readout of stored charge images may be obtained in a known manner using readout signals coupled to output terminal 49 by a capacitor 48 connected to the junction of series-connected resistors 34, 38. Superior hard copies of stored information are obtained because of the high contrast characteristics of the target.

While the best mode presently contemplated for practicing the invention has been described and several modifications suggested, it will be apparent to those skilled in the art that various other changes may be made without departing from the teachings set forth herein. The scope of the present invention thus is to be determined only by reference to the following claims.

I claim as my invention:

1. A bistable storage target for a cathode-ray tube, comprising a support surface of electrically insulative material, a layer of conductive material disposed on said surface, said conductive layer including a plurality of openings forming a first aperture pattern, a storage layer of secondary electron emissive material in contact with said support surface, said layer comprising a multiplicity of spaced deposits of such material including one within each opening of said first pattern, and a layer of insulating material overlying said conductive layer, said insulating layer including a like plurality of openings forming a second aperture pattern substantially in register with said first pattern, the individual openings of said second pattern being smaller in size than the corresponding openings of said first pattern, with portions of said insulating layer engaging regions of said support surface surrounding each deposit of storage material thereby to insulate said deposits from said conductive layer.

2. The storage target of claim 1, where said insulating layer includes multiple openings forming a third pattern of apertures delimiting portions of said conductive layer at locations intermediate the openings of said first pattern.

3. The storage target of claim 2, wherein said delimited portions are coated with a conductive material different from that of said conductive layer.

4. The storage target of claim 3, wherein said conductive layer is of a substantially transparent conductive material.

5. The storage target of claim 1, wherein said storage layer material comprises a phospher material.

6. The storage target of claim 5, wherein said insulating layer material comprises a phosphor material having a perceived color emission different from that of said storage layer material.

7. The storage target of claim 5, wherein said insulating layer material comprises a non-storing phosphor material that emits light of a different perceived color and that has a lower emission efficiency under low velocity electron bombardment than the storage layer phosphor material.

8. The storage target of claim 5 wherein said insulating layer material is a nonphosphorescent material.

9. The storage target of claim 8, wherein said insulating layer material has a secondary electron emission ratio ($\delta$) exceeding that of said storage layer material.

10. A bistable storage target for a cathode-ray tube that includes means for generating a beam of relatively high velocity electrons directed toward said target and for deflecting said beam over a surface of said target to write a charge image thereon, and additionally that includes means for flooding said surface with relatively low velocity electrons to cause bistable storage of said charge image, said target comprising a support surface of electrically insulative material, a pattern layer of conductive material on said surface, said conductive layer including a first array of openings therein.

a pattern layer of insulating material overlying said conductive layer, said insulating layer including a second array of openings therein, said second array being disposed substantially in register with said first array, the individual openings of said second array being smaller than the corresponding openings of said first array, portions of said insulating layer overlapping the edges of the fist array openings and contacting said support surface to define insulated sites for the location of charge image storage elements, and a multiplicity of deposits of secondary electron emissive material on said support surface, including one at each of said sites.

11. The storage target of claim 10, wherein said insulating layer further includes a third array of openings delimiting regions of said conductive layer at locations intermediate the openings of said first array.

12. The storage target of claim 11, wherein said delimited regions remain uncovered thereby to facilitate collection of secondary electrons by said conductive layer.

* * * * *

UNITED STATES PATENT AND TRADEMARK OFFICE

CERTIFICATE OF CORRECTION

PATENT NO. : 4,254,360

DATED : March 3, 1981

INVENTOR(S) : Duane A. Haven

It is certified that error appears in the above-identified patent and that said Letters Patent are hereby corrected as shown below:

Col. 1, line 52 reads "collector phosphor" should be --collector/phosphor--.

Col. 1, line 53 reads "($\delta$ >)" should be --($\delta$ < 1) --.

Col. 3, line 10 reads "writing reading" should be --writing/reading--.

Col. 3, line 11 reads "next portion" should be --neck portion--.

Col. 3, line 43 reads "elctrode" should be --electrode--.

Col. 5, line 13 reads "insulator phosphor" should be --insulator/phosphor--.

Col. 5, line 59 reads "Ml.)" should be --ml.)--.

Col. 6, line 47 reads "3,292,473" should be --3,293,473--.

Signed and Sealed this

*Twelfth* Day of *October 1982*

[SEAL]

*Attest:*

GERALD J. MOSSINGHOFF

*Attesting Officer*

*Commissioner of Patents and Trademarks*